US010745858B1

(12) United States Patent
Lawson et al.

(10) Patent No.: US 10,745,858 B1
(45) Date of Patent: Aug. 18, 2020

(54) THROUGH-AIR DRYING APPARATUS AND METHODS OF MANUFACTURE

(71) Applicant: Kimberly-Clark Worldwide, Inc., Neenah, WI (US)

(72) Inventors: Daniel Keith Lawson, Owensboro, KY (US); Eric Kent Isom, Jr., Appleton, WI (US); Kenneth John Zwick, Neenah, WI (US); Robert James Seymour, Appleton, WI (US); Craig Steven Besaw, Stevens Point, WI (US); Christopher Lee Satori, Hortonville, WI (US); Peter John Allen, Neenah, WI (US); Mark Alan Burazin, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/462,976

(22) PCT Filed: Jun. 27, 2018

(86) PCT No.: PCT/US2018/039814
§ 371 (c)(1),
(2) Date: May 22, 2019

(87) PCT Pub. No.: WO2020/005236
PCT Pub. Date: Jan. 2, 2020

(51) Int. Cl.
*D21F 1/00* (2006.01)
*D21F 5/18* (2006.01)
(Continued)

(52) U.S. Cl.
CPC ..... *D21F 1/0027* (2013.01); *D21F 5/182* (2013.01); *D21F 11/14* (2013.01); *F26B 13/16* (2013.01); *F26B 21/10* (2013.01)

(58) Field of Classification Search
CPC ..... F26B 13/00; F26B 13/16; F26B 21/00; F26B 21/10; D21F 1/0027; D21F 5/182; D21F 11/14
(Continued)

(56) References Cited

U.S. PATENT DOCUMENTS 3,432,936 A 3/1969 Cole et al.
3,751,822 A * 8/1973 Crist ..... D21F 5/02 34/116
(Continued)

FOREIGN PATENT DOCUMENTS

CA 2951068 A1 * 1/2016 ..... F26B 5/02
CN 1657700 A 8/2005
(Continued)

*Primary Examiner* — Stephen M Gravini
(74) *Attorney, Agent, or Firm* — Kimberly-Clark Worldwide, Inc.

(57) ABSTRACT

Methods of improving the drying rate of a cellulosic web, such as a tissue web, by providing an apparatus having two noncompressive dewatering devices, such as two through-air driers, where the temperature of the drying medium supplied to each device is separately controlled. The temperature of the medium supplied to the first device may exceed 450° F., such as from about 450 to about 600° F. On the other hand the temperature of the medium supplied to the second device may be less than the temperature supplied to the first, such as from about 350 to 450° F. Drying the web in this manner not only improves drying efficiency, but also limits or prevents degradation of the web, such as the combustion of cellulosic fibers making up the web or monosaccharides associated therewith. As such, webs that are substantially free from furan and acetaldehyde may be produced by the present methods.

20 Claims, 2 Drawing Sheets

(51) Int. Cl.
*D21F 11/14* (2006.01)
*F26B 21/10* (2006.01)
*F26B 13/16* (2006.01)

(58) Field of Classification Search
USPC ..... 34/417, 110–124
See application file for complete search history.

(56) References Cited

U.S. PATENT DOCUMENTS 4,194,947 A * 3/1980 Huostila ..... D21F 5/182 162/207
4,882,855 A * 11/1989 Loser ..... D21F 5/04 34/116
5,666,744 A * 9/1997 Thorp ..... D21F 5/00 34/132
5,974,691 A 11/1999 Marchal et al.
6,149,767 A * 11/2000 Hermans ..... D21F 11/14 162/109
6,199,296 B1 * 3/2001 Jewitt ..... D21F 5/182 34/115
6,631,566 B2 10/2003 Ross et al.
6,732,452 B2 5/2004 Lin et al.
6,740,200 B2 * 5/2004 Seymour ..... D21F 11/00 162/111
6,820,837 B2 * 11/2004 Long ..... B65H 19/126 242/554.2
7,462,257 B2 * 12/2008 Beuther ..... D21F 11/006 162/111
7,972,474 B2 * 7/2011 Underhill ..... D21F 11/14 162/111
8,137,505 B2 * 3/2012 Hada ..... D21F 5/182 162/118
8,262,857 B2 * 9/2012 Hermans ..... D21H 21/18 162/112
8,402,673 B2 * 3/2013 Da Silva ..... D21F 5/182 162/206
9,696,088 B2 * 7/2017 Bohn ..... F26B 21/02
10,240,292 B2 * 3/2019 Hassman ..... D21H 27/002
10,488,108 B2 * 11/2019 Plavnik ..... F26B 13/00
10,519,606 B2 * 12/2019 Swails ..... D21F 11/001
2002/0069551 A1 6/2002 Ross et al.
2005/0072023 A1 4/2005 Hada et al.
2005/0072543 A1 4/2005 Hada et al.
2013/0299107 A1 * 11/2013 Shannon ..... D21H 27/002 162/123
2015/0159329 A1 * 6/2015 Tan ..... C08L 29/04 162/111
2016/0145810 A1 * 5/2016 Miller, IV ..... D21H 5/14 162/111
2017/0096775 A1 4/2017 Anzel et al.
2019/0271105 A1 * 9/2019 Li ..... D04H 3/105
2019/0292729 A1 * 9/2019 Tan ..... D21F 5/184
2020/0087857 A1 * 3/2020 Penteado ..... D21H 27/002

FOREIGN PATENT DOCUMENTS

CN 106283816 A 1/2017
DE 102006062235 A1 * 6/2008 ..... D21F 9/003
EP 2106483 B1 * 3/2016 ..... D21F 5/20
WO 9323616 A1 11/1993
WO WO-2016003601 A1 * 1/2016 ..... F26B 3/04
WO 17151096 A1 9/2017

* cited by examiner

THROUGH-AIR DRYING APPARATUS AND METHODS OF MANUFACTURE

BACKGROUND OF THE DISCLOSURE

In the manufacture of paper webs, such as tissue webs, a slurry of cellulosic fibers is deposited onto a forming wire to form a wet embryonic web. The resulting wet embryonic web may be dried by any one of or combinations of known means, where each drying means may potentially affect the properties of the resulting tissue web. For example, the drying means may affect the softness, caliper, tensile strength, and absorbency of the resulting cellulosic tissue web.

An example of one drying means is through-air drying. In a typical through-air drying process, a foraminous air permeable fabric supports the embryonic web to be dried. Hot air flow passes through the web, then through the permeable fabric or vice versa. The air flow principally dries the embryonic web by evaporation. Regions coincident with and deflected into fabric voids are preferentially dried. Regions of the web coincident with solid regions of the fabric, such as woven knuckles, are dried to a lesser extent by the airflow as the air cannot pass through the fabric in these regions.

To improve the efficiency and effectiveness of through-air drying several improvements to through-air drying fabrics have been made. For example, the in certain instances the air permeability of the fabric has been increased by manufacturing the fabric with a high degree of open area. In other instances fabrics have been impregnated with metallic particles to increase their thermal conductivity and reduce their emissivity. In still other instances the fabric itself has been manufactured from materials specially adapted for high temperature airflows. Examples of such through-air drying technology are found, for example, in U.S. Pat. Nos. 4,172,910, 4,251,928, 4,528,239 and 4,921,750.

While the foregoing fabric improvements have resulted in certain beneficial gains, they have not yet successfully addressed problems associated with through-air drying non-uniform tissue webs. For example, a tissue web having a first region with lesser absolute moisture, density or basis weight than a second region, will typically have relatively greater airflow through the first region compared to the second. This relatively greater airflow occurs because the first region of lesser absolute moisture, density, or basis weight presents a proportionately lesser flow resistance to the air passing through such region. As a result the first and second regions dry at different rates and may ultimately result in a web having variable moisture content and/or physical properties.

Drying of the paper web is often rate limiting and is dependent upon the drying time and the drying rate. Decreasing the drying time typically requires increases in the dimensions of the dryer, which is capital intensive, and therefore papermakers often seek to maximize the drying rate to improve drying. The drying rate (R in g/m^2/s) in a typical papermaking process is described by:

$$R = \frac{h}{\varphi}(T_{supply} - T_{sheet}) \qquad \text{(Equation 1)}$$

Where h is the heat transfer coefficient (having units of $W/m^2$ K), φ is the latent heat of water evaporated during drying, $T_{sheet}$ is the temperature of the web and $T_{supply}$ is the air temperature of the air supplied the dryer. The heat transfer coefficient is influenced by the mass of air contacting the web during the drying process. The latent heat (φ) of the water evaporated during drying is typically about 2265 joules per gram (j/g) and is constant for a given web temperature. The temperature of the web begins at the wet bulb temperature when the web is wet and rises to the temperature of the heated dryer air.

To improve the efficiency of through-air drying the supply temperature is often increased. The maximum supply temperature however is limited by several factors such as the ignition temperature of the sheet and the melting temperature of the carrying fabric. For example, webs made from wood pulp fibers may begin to degrade when the web temperature exceeds 300° F. and produce off odors and polyester, which is commonly used in the manufacture of carrying fabrics, undergoes hydrolysis at about 350° F. and melts at 480° F.

To overcome these limitations, the prior art has often resorted to alternative through-air dryer designs and the introduction of alternate drying medium. For example, U.S. Pat. No. 6,732,452 teaches the addition of high temperature steam to the drying medium to increase the supply temperature and eliminate the scorching or burning of the drying web. Such methods however, often introduce complexities to the manufacturing process and require additional capital improvements.

Thus, there remains a need in the art for more efficient through-air drying processes, particularly processes that can accommodate non-uniform tissue webs and the use of fabrics having varying degrees of air permeability. Further there is a need for a means of increasing the supply temperature using existing through-air drying apparatuses without damaging the nascent web or negatively affecting important web properties.

SUMMARY OF THE DISCLOSURE

It has now been discovered that the drying rate may be improved by providing a tissue making machine having two noncompressive dewatering devices, such as two through-air driers, where the temperature of the drying medium supplied to each of the devices is separately controlled. The temperature of the medium, such as heated ambient air, supplied to the first drying device may be increased to in excess of 450° F. (232° C.), and in certain instances in excess of 475° F. (246° C.), such as from about 450 to about 700° F. (232 to 371° C.), such as from 475 to about 600° F. (246 to 315° C.) so long as the web remains wet, such as a water content greater than about 0.10 grams of water per gram of fiber (referred to herein as a "moisture ratio"), such as from about 0.10 to about 0.35 g/g and more preferably from about 0.10 to about 0.30 g/g, as it passes over the drying device. Further, it is generally preferred that the wet web substantially cover the carrier fabric that transports the wet web over the noncompressive dewatering devices. Transporting such a wide web over the noncompressive dewatering devices may require trimming of the edges of the web after the web has been dried and exists the noncompressive dewatering devices.

Because the web is only partially dewatered when contacted by the high temperature supply-side air the and is not fully dried as it passes over the drying apparatus the temperature of the nascent web is maintained below 450° F. (232° C.) and more preferably below 400° F. (204° C.), such as from about 200 to about 450° F. (93 to 232° C.). Further, because the partially dewatered web is supported by a fabric, particularly a polymeric fabric, as it passes over the drying apparatus not all of the heat from the high temperature supply-side air is transferred to the nascent web. Rather, a portion of the heat is transferred to the fabric and further limits the possibility of over drying the web or exceeding the webs ignition temperature. Therefore, the present invention provides a means of increasing the temperature of the supply-side air above the glass transition point of the cellulosic fibers without igniting the fibers or otherwise negatively affecting the physical properties of the fiber.

Accordingly, in certain embodiments, the present invention provides a means of increasing the efficiency of non-compressively drying a cellulosic web, such as a tissue web, without scorching or burning of the cellulosic fibers of the nascent web or otherwise negatively effecting the physical properties of the resulting tissue product. In fact, in certain instances, the present invention may be used to improve certain physical properties of the resulting tissue product. For example, the use of an elevated through-air drying temperature may improve molding of the web to the through-air drying fabric as the web is transported over the first dewatering device. The improved molding may, in-turn, improve certain physical properties of the resulting tissue web, such as sheet bulk and surface texture.

Thus, in one embodiment the present invention provides a tissue apparatus comprising at least two noncompressive dewatering devices, such as two through-air driers, where the first device is supplied with air having a temperature greater than about 450° F. (232° C.), and in certain instances greater than 475° F. (246° C.), such as from about 450 to about 700° F. (232 to 371° C.), and the second is supplied with air having a lower temperature, such as less than about 500° F. (260° C.), more preferably less than about 470° F. (243° C.) and more preferably less than 450° F. (232° C.). In this manner the invention provides a through-air drying apparatus which reduces the necessary residence time of the embryonic web thereon and/or requires less energy than had previously been thought in the prior art to dry the web to a final dryness. Further, by providing an apparatus having at least two drying zones is provided where each drying zone may be specifically adapted to maximize the efficiency of tissue web manufacture and/or maximize tissue web physical properties.

In another embodiment the invention provides a method of through-air drying a tissue web comprising the steps of transferring a wet tissue web having a moisture ratio less than about 2.3 g/g (greater than about 30 percent consistency) to a through-air drying fabric; transporting the web and fabric over a first through-air dryer and through-air drying the wet tissue web at a first temperature to form a partially dewatered tissue web; transporting the web and fabric over a second through-air dryer and through-air drying the wet tissue web at a second temperature to form dried tissue web, wherein the first temperature is greater than the second temperature.

In yet another embodiment the present invention provides a method of through-air drying a tissue web comprising the steps of dispersing a pulp slurry on a forming fabric to form a wet tissue web; partially dewatering the wet tissue web to a moisture ratio less than about 2.3 g/g (greater than about 30 percent consistency); transferring the partially dewatered tissue web to a through-air drying fabric; transporting the partially dewatered web over a first through-air dryer supplied with a through-air drying medium having a temperature from 475 to about 600° F. (246 to 315° C.); transporting the web over a second through-air dryer supplied with a through-air drying medium having a temperature less than about 475° F. (246° C.) to dry the web to a moisture ratio less than about 0.03 g/g.

In still another embodiment the present invention provides a method of manufacturing a through-air dried tissue comprising the steps of depositing an aqueous suspension of papermaking fibers onto a forming fabric to form a wet web, transferring the wet web to a through-air fabric, transporting the wet web, which generally has a moisture ratio less than about 2.3 g/g (greater than about 30 percent consistency) over a first through-air dryer supplied with air having a temperature from 475 to about 600° F. (246 to 315° C.) thereby drying the web to a moisture ratio from about 0.20 to about 0.70 g/g, transporting the partially dried web over a second through-air dryer supplied with air having a temperature less than about 475° F. (246° C.) thereby drying the web to a moisture ratio less than about 0.03 g/g.

In another embodiment the present invention provides a method of manufacturing a tissue web comprising the steps of depositing an aqueous furnish comprising cellulosic fiber on a foraminous support to form a wet tissue web; partially dewatering the web to a yield a partially dewatered web having a moisture ratio less than about 2.3 g/g, transferring the partially dewatered tissue web to a through-air drying fabric and transporting the web and fabric over a first noncompressively dewatering device supplied with heated air having a temperature from 475 to about 600° F. (246 to 315° C.) to dry the web to a moisture ratio from about 0.20 to about 0.70 g/g; transporting the fabric and the partially dried web over a second noncompressively dewatering device supplied with heated air having a temperature less than about 475° F. (246° C.) thereby drying the web to a moisture ratio less than about 0.03 g/g, such as from about 0.01 to about 0.03 g/g.

DEFINITIONS

Figure 1:
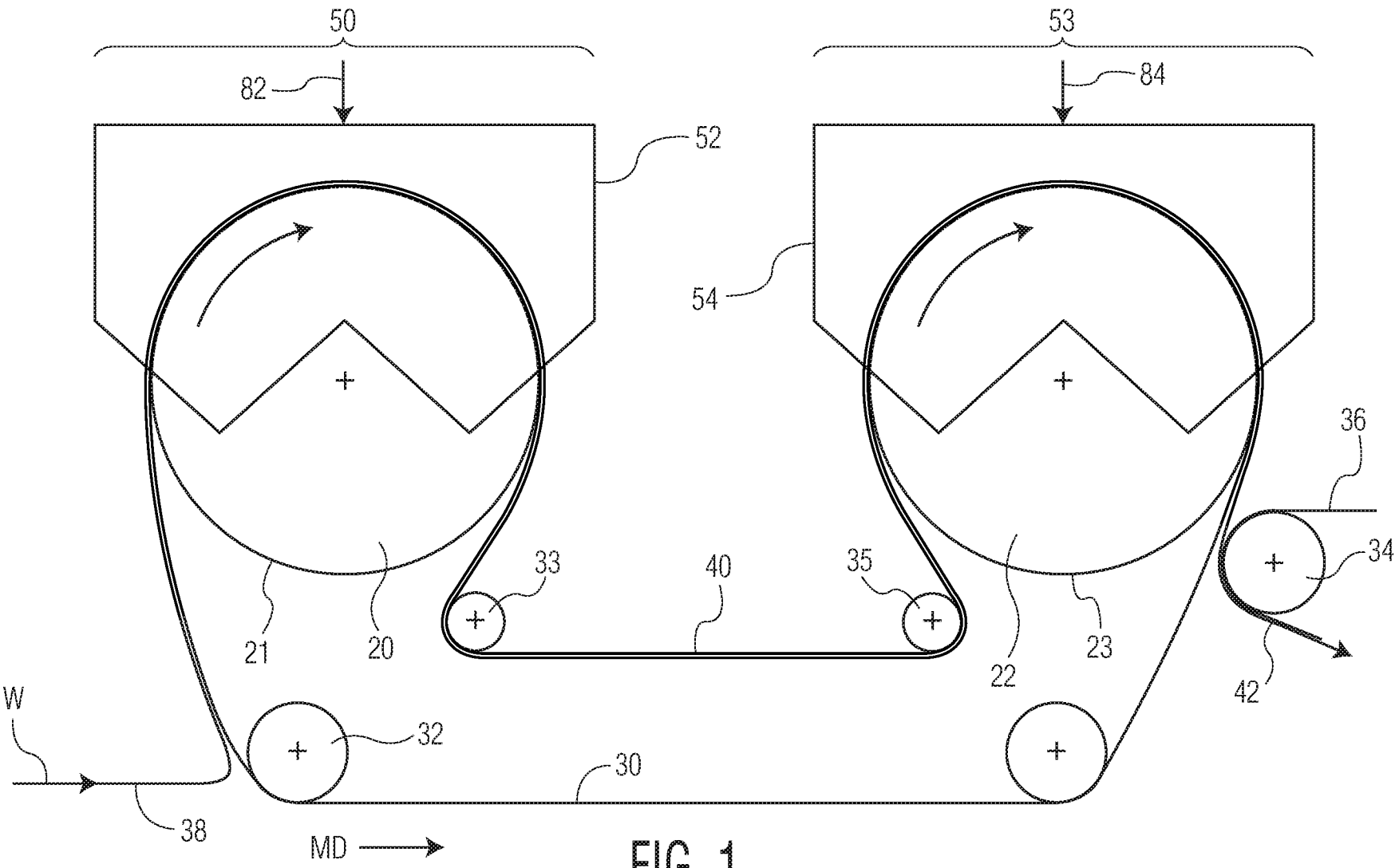
FIG. 1 is a schematic view of a through-air drying apparatus according to one embodiment of the present invention.

As used herein the term "moisture ratio" when referring to the moisture content of a fibrous mat, such as a tissue web, generally refers to grams of water per gram of dry fiber.

As used herein the term "consistency" when referring to the moisture content of a fibrous mat, such as a tissue web, generally refers to the grams of fiber per gram of wet sheet and may be calculated as follows:

$$\text{Consistency} = \frac{100}{(x-1)} \qquad \text{(Equation 2)}$$

where X is the moisture ratio having units of grams per gram (g/g).

As used herein the term "fabric" refers to any endless fabric or belt used for making a tissue sheet, either by a wet-laid process or an air-laid process. The fabrics useful in the present invention can be woven fabrics or non-woven fabrics.

As used herein, the term "non-woven fabric" refers to non-woven material which is in the form of a continuous loop or can be formed into a continuous loop, for example, by virtue of a seam. Non-woven fabrics, such as those comprising spiral-laminated non-woven webs, are particularly suitable for use in accordance with this invention.

As used herein the term "through-air dried" refers to a method of manufacturing a tissue web where a drying medium, such as heated air, is blown through a perforated cylinder, the embryonic tissue web and the fabric supporting the web. Generally the embryonic tissue web is supported by the fabric and is not brought into contact with the perforated cylinder.

As used herein, "noncompressive dewatering" and "noncompressive drying" refer to dewatering or drying methods, respectively, for removing water from tissue webs that do not involve compressive nips or other steps causing significant densification or compression of a portion of the web during the drying or dewatering process. In certain instances it may be preferable that the wet web is wet-molded in the process of noncompressive dewatering to improve the three-dimensionality and absorbent properties of the web. As used herein, "wet-molded" tissue sheets are those which are conformed to the surface contour of a fabric while at a moisture ratio from about 1.5 to about 2.5 g/g and then further dried by through-air drying.

As used herein the term "tissue web" refers to a fibrous structure provided in sheet form and being suitable for forming a tissue product. Tissue webs manufactured according to the present invention generally have a basis weight greater than about 10 grams per square meter (gsm), such as from about 10 to about 100 gsm and more preferably from about 15 to about 60 gsm and web bulks (the inverse of density) greater than about 3 cubic centimeters per gram (cc/g), such as from about 3 to about 25 cc/g and more preferably from about 10 to about 20 cc/g. Tissue webs are generally manufactured from a fibrous furnish, such as cellulosic fibers and more particularly cellulosic wood pulp fibers.

As used herein "uncreped through-air dried" or UCTAD refers to a process of making a material, and to the material made thereby, by forming a furnish of cellulosic fibers, depositing the furnish on a traveling foraminous belt, subjecting the fibrous web to noncompressive drying to remove the water from the fibrous web, and removing the dried fibrous web from the traveling foraminous belt. Such webs are described in U.S. Pat. Nos. 5,048,589, 5,348,620 and 5,399,412.

DETAILED DESCRIPTION OF THE DISCLOSURE

It has now been discovered that the drying rate may be improved by providing a tissue making machine having two noncompressive dewatering devices, such as two through-air driers, where the supply temperature of each the devices may be separately controlled. The temperature of the air supplied to the first dewatering device may be increased to in excess of 450° F., and in certain instances greater than 500° F., such as from about 475 to about 600° F., such as from 500 to about 575° F. On the other hand the temperature of the air supplied to the second dewatering device is generally less than the temperature of the air supplied to the first. For example, if the temperature of air supplied to the first dewatering device may be increased to in excess of 550° F., the temperature of air supplied to the first dewatering device may range from 400 to 490° F.

The temperature the drying medium supplied to the first through-air dryer may exceed 450° F. so long as the sheet is only partially dried and the temperature of the sheet is less than about 450° F., more preferably less than about 375° F. and still more preferably less than about 340° F. As will be discussed in more detailed below, maintaining the sheet at the foregoing temperatures generally limits thermal degradation products of cellulose often associated with drying cellulosic fibers at high temperature and which can impart foul odors to the finished cellulosic products.

Generally it is preferred that the moisture ratio of the web as it exits the first through-air dryer is maintained at a sufficient high level so as not to exceed a sheet temperature of about 450° F. when the temperature of the drying medium supplied to the first through-air dryer is in excess of 450° F., such as such as from about 475 to about 600° F. The relationship between $T_{supply}$ (temperature of drying medium supplied to the through-air dryer), $T_{sheet}$ (desired maximum sheet temperature), and moisture ratio of the sheet may be expressed as:

$$X > \frac{\ln\left(\frac{(T_{supply} - T_{sheet})}{(T_{supply} - T_{wet\ bulb})} - 1\right)}{2.3} \quad \text{(Equation 3)}$$

Where all temperatures are provided in degrees Fahrenheit. For example, to maintain a sheet temperature of less than 450° F. at a supply temperature of 600° F., the moisture ratio of the sheet should be maintained at 0.20 g/g or greater as it is passed over the first through-air drier. In other instances to maintain a sheet temperature less than 340° F. at a supply temperature of 500° F. Supply the moisture ratio of the web as it is passed over the first through-air dryer should be maintained within the range from 0.07 to 0.30.

Accordingly, the temperature of the sheet may be maintained at a temperature less than 450° F. even when the medium supplied to the first dewatering device exceeds 500° F. so long as the web remains wet, such as a moisture ratio greater than about 0.05 grams of water per gram of fiber, such as from about 0.05 to about 0.35 g/g and more preferably from about 0.10 to about 0.30 g/g. Despite having a temperature in excess of the combustion temperature of the cellulosic web and the oxygen content of the ambient air of the machine room, the high temperature air does not ignite the fibers or otherwise negatively affect their physical properties.

While the moisture content of the partially dewatered web may vary depending on the temperature of the drying medium supplied to the first through-air drier and the desired maximum sheet temperature, in certain embodiments the moisture ratio of the partially dewatered web may range from 0.10 to about 2.5 g/g, such as from about 0.50 to about 2.3 g/g. As the web passes over the first through-air drier it is generally preferred that the nascent web is not fully dried and as such the moisture ratio of the partially dried web may range from about 0.075 to about 0.30 g/g, such as from about 0.10 to about 0.25 g/g. For example, a partially dewatered web having a moisture ratio from about 0.50 to about 2.3 g/g is conveyed over a first through-air drier supplied with air having a temperature from about 475 to about 600° F. and partially dried to a moisture ratio from about 0.075 to about 0.30 g/g as it passes over the drying apparatus. During this entire drying period, the supply-side air may be maintained at greater than 475° F. without the temperature of the nascent web exceeding 400° F. In certain instances the temperature of the partially dried web may range from about 200 to about 400° F. and more preferably from about 200 to about 375° F. and more preferably from about 200 to about 340° F. As such the web may be effectively dried without igniting the cellulosic fibers or otherwise negatively affecting the physical properties of the fiber.

Accordingly, the present invention provides a means for efficiently drying a web while limiting the thermal degradation products of cellulose often associated with drying cellulosic fibers at high temperature and which can impart foul odors to the finished cellulosic products. For example, the present invention may be employed to limit the production of compounds selected from the group consisting of furan, 2-methyl furan, 2-pentyl furan, acetaldehyde, and combinations thereof, which are known to be produced as a result of thermal degradation of monosaccharides present in the cellulosic fibers, particularly cellulosic kraft pulp fibers. Preferably webs produced according to the present invention have furan levels less than about 20 ppm, such as less than about 10 ppm, such as less than about 5.0 ppm, such as less than about 2.0 ppm, and more preferably are non-detectable. In other instances the webs have acetaldehyde levels less than about 20 ppm, such as less than about 10 ppm, such as less than about 5.0 ppm, such as less than about 2.0 ppm, and more preferably are non-detectable. For example, the webs may have a furan concentration from 0 to about 2.0 ppm, more preferably from 0 to 1.5 ppm, and an acetaldehyde concentration from 0 to about 2.0 ppm, more preferably from 0 to 1.0 ppm. In certain instances it may be preferred that the dried web is substantially free from furan and acetaldehyde. As used herein, the term "substantially free" when used in reference to furan and acetaldehyde means that the concentration of the compounds is less than their detection limits using test methods as described herein, such as less than about 1.5 ppm for furan and less than about 0.5 ppm for acetaldehyde.

The methods and apparatus of the present invention are generally well suited for the manufacture of tissue webs and particularly through-air dried tissue webs. The apparatus generally comprises two or more noncompressive dewatering means, such as through-air driers, in serial alignment with one another. For example, the present invention provides an apparatus for drying a wet tissue web comprising at least two through-air dryers (TADs), each dryer including a rotatable cylinder having a porous cylindrical deck, a first fabric wrapped about a portion of the circumference of the first through-air dryer deck, a second fabric wrapped about a portion of the circumference of the second through-air dryer deck, and plurality of web transfer devices positioned relative to each cylinder so as to direct the fabric and/or web onto and from each cylinder. Generally the fabrics partially encircling each TAD will be referred to herein collectively as TAD fabrics and individually as the first TAD fabric (encircling the most upstream TAD and the first TAD encountered by the embryonic web) and the second TAD fabric (encircling the TAD downstream from and adjacent to the first TAD).

The noncompressive dewatering means may preferably comprise a through-air dryer. Through-air dryers are generally well known in the art and any of such through-air dryers can be utilized in the present invention. For example, some suitable through-air dryers are described in U.S. Pat. Nos. 4,462,868, 5,465,504 and 5,937,538, which are incorporated herein by reference in a manner consistent with the present disclosure. Each TAD generally comprises an outer rotatable perforated cylinder and an outer hood. The hood is used to direct a heated drying medium from a drying medium supply duct and source against and through the fibrous web and fabric, as is known to those skilled in the art. The TAD fabric carries the fibrous web over the upper portion of the through-air dryer outer cylinder. The drying medium is forced through the web and fabric and through the perforations in the outer cylinder of the TAD. The drying medium removes the remaining water from the fibrous web and exits the cylinder via conduits in proximity to outlets positioned along the axis of the cylinder.

Thus, in certain preferred instances, the present invention provides two or more TADs each having a rotatable cylinder and a plurality of web transfer devices disposed adjacent thereto for directing the fabric and the tissue web onto and from each cylinder. The TAD may be configured to provide an inward flow of the drying medium, such as hot air or steam, wherein the drying medium is flowed from the exterior of the cylinder through the tissue web, the fabric, and the deck and into the interior of the cylinder. For an inward flow configuration, the embryonic tissue web is supported by the TAD fabric on an outer surface thereof and the fabric lies between the web and the deck as the web is transported about the TAD. For example, in an inward flow configuration such as shown in FIG. 1, the drying medium 82, 84 is flowed through the tissue web W, the fabric 30 and perforated exterior surface 21, 23 into the interior of the drying cylinder 20, 22 before being exhausted.

Alternatively, the TAD may be configured in an outward flow arrangement wherein the drying medium flows from the interior of the cylinder through the deck, the TAD fabric, and the web to the exterior of the cylinder. Preferably, with an outward flow configuration, the web is supported between two fabrics as it is carried about the cylinder of the TAD. In still other instances the TAD may be configured in a cross flow arrangement whereby the drying medium is flowed both into and out of the interior of the cylinder through the deck.

Generally the carrier fabric, also referred to as a through-air drying fabric or a TAD fabric, comprises woven filaments and has a web contacting surface and an opposite machine contacting surface that is configured to cooperate with the TAD to form a system for drying the web supported thereon. In certain instances the fabric may be woven from polyester or polyethyleneterephthalate (PET) polyphenylenesulfide (PPS) or polyetheretherketone (PEEK) monofilament yarns.

The fabric can be applied in a TAD having a rotatable cylinder that may or may not have deckle bands. The TAD may include a medial portion configured to allow air to flow there through and solid edge portions which hold and support the shell structure of the medial portion and define the lateral ends of the cylinder. In such a configuration, the medial portion defines the maximum width over which air can be directed into or out of the cylinder. To protect the underlying fabric from the high temperature drying medium introduced to the first through-air dryer, the width of the web may be somewhat greater than the width of the medial portion of the cylinder. In other instances, to provide protection for the underlying fabric, the width of the web corresponds to the width of the web-carrying portion of the fabric.

The fabric may be configured to withstand a temperature of at least about 500° F. and, in some instances, a temperature of at least about 550° F., such as from about 500 to about 550° F., without premature degradation. As such, the fabric and web supported thereby may be configured to withstand the heated drying medium between the hood and the cylinder of the TAD such as by configuring the web to entirely cover the fabric as it is transported over the TAD. Because web-carrying portion of the fabric will be cooled by evaporation of the water within the partially dewatered web, thereby reducing or minimizing premature degradation of the fabric, as compared to the heated air flowing through portions of the fabric not covered by the web.

The TAD configured with the fabric having its entire width, including any laterally-spaced strip portions, protects the lateral edges of the fabric from having hot TAD supply air flowing there through by eliminating the gap between lateral edges of the web and the edge portions of the rotating TAD cylinder. In this manner, the service life of the fabric may be increased by minimizing or eliminating fabric degradation in the gap, while allowing higher temperatures (i.e., over about 450° F.) of the supply air in the TAD to be utilized. The increased efficiency and/or production capacity realized by more effective use of the drying air, in addition to the faster drying realized by the higher supply air temperatures, thus provide an advantageous system for drying a web.

With further reference to FIG. 1, one embodiment of an apparatus for drying a tissue web is illustrated. As is generally known in the art a wet tissue web may be formed by depositing a dilute suspension containing fibers and more preferably cellulosic fibers via a sluice onto a foraminous surface. Once deposited on the foraminous surface water is removed from the web by combinations of gravity, centrifugal force and vacuum suction depending upon the forming configuration. Once formed, the partially dewatered web 38 (also referred to herein as a partially dewatered web), traveling in the machine direction (MD) indicated by the arrow, may be transferred to a carrier fabric 30, such as a TAD fabric, with the assistance of a vacuum roll 32. Once transferred to the fabric 30, the partially dewatered web 38 is supported by the fabric 30 and conveyed over a portion of a first TAD 20 to dry the web (W). A "partially dewatered" paper web is initially provided to the first dryer section 50 to be dried. As used herein, the phrase "partially dewatered" generally refers to paper webs having a low solids consistency. For instance, a web may be supplied to the first dryer section at a moisture ratio of greater than about 1.5 g/g, particularly from about 1.7 to about 2.5 g/g, and more particularly from about 2.0 to about 2.3 g/g.

The drying apparatus generally comprises first and second dryers 50, 53, where each dryer is a through-air drying apparatus comprising a rotatable cylinder 20, 22 having a perforated surface 21, 23 and an outer hood 52, 54. Each hood 52, 54 is used to direct a drying medium 82, 84 from the drying medium supply duct. The drying medium 82, 84 is discharged against and through the fibrous web (W) and the through-air drying fabric 30 as is known to those skilled in the art. After passing through the web (W) and fabric the drying fabric 30, medium 82, 84 passes through the perforations in the outer surface 21, 23 of the TAD and is recirculated and/or vented to the atmosphere.

As the web 38 is moved through the first dryer section 50, it is partially dried to yield a partially dried web 40. As the web 38 is introduced and conveyed through the first dyer section it is partially dewatered so that very little, if any, heated air actually passes through the web. Rather, the air generally impinges on the surface of the web, and heats the web to evaporate the moisture contained thereon. After contacting the web surface, the air can then flow along with the web and/or through the web into the interior of the cylinder, where it can be exhausted.

After exiting the first dryer section 50 the partially dried web 40, which continues to be supported by the through-air drying fabric 30 and guided by spaced part through-air dryer guide rollers 33, 35, enters a second dryer section 53 for further drying. In general, the web 40 entering the second dryer section is "partially dried." As used herein, the phrase "partially dried" generally refers to paper webs having a higher solids consistency than a "partially dewatered" web. For example, "partially dewatered" webs having consistencies within the above-mentioned ranges can be dried to a moisture ratio less than about 1.5 g/g, more preferably less than about 1.0 g/g and still more preferably less than about 0.75 g/g, such as from about 0.20 to about 0.70 g/g, within the first dryer section to result in a "partially dried" web.

As the partially dried web 40 is moved through the second dryer section 53, it is further dried to yield a dry tissue web 42. The drying medium 84 introduced to the hood 54 of the second dryer section 53 is generally cooler than the first drying medium 82 and may have a temperature from less than 450° F. (232° C.) and more preferably less than 400° F. (204° C.), such as from about 350 to about 450° F. (176 to 232° C.). As the partially dried web is conveyed through the second dryer section it is relatively permeable such that the drying medium introduced to the second dryer section may flow through the web into the interior of the cylinder, where it can be exhausted.

Upon exiting the second dryer section 53 the dried tissue web 42, which continues to be supported by the through-air drying fabric 30, is then transferred to a first dry end transfer fabric 36 with the aid of a vacuum transfer roll 34. The dried web 42 may subsequently be disposed between the first dry end transfer fabric 36 and a second dry end transfer fabric. The tissue web may then be carried to a first winding nip formed between the reel spool and the outer surface of the second dryer end transfer fabric. The web may then be wound into a roll.

While in one embodiment the manufacture of tissue webs using the inventive drying apparatus does not involve a creping step, the invention is not so limited. In certain embodiments the tissue web may be creped or otherwise treated after being noncompressively dewatered a second time. For example, in certain embodiments, a web having a moisture ratio from about 0.1 to about 1.0 g/g may be transferred from a fabric encircling the downstream cylinder onto an impression fabric using a web transfer apparatus. Once the web has been transferred to the impression fabric it may be pressed against the surface of another cylinder, such as a Yankee dryer, and creped therefrom to yield a dried tissue web.

Accordingly, the invention is not limited by the processing steps occurring after the web is conveyed across the second noncompressive dewatering device. Rather, the present invention resides in at least two noncompressive dewatering devices wherein each of the devices is supplied with a through-air drying medium, such as heated air, having different temperatures. For example, the temperature of the drying medium, such as heated air, within the first dryer section 50 and the second dryer section 53 can be selectively controlled to improve the overall capacity of the drying apparatus. In particular, a higher temperature can be provided to the first dryer section 50 when the web is partially dewatered and a lower temperature can be provided to the second dryer section 53 when the web is partially dried. For instance, in one example, a temperature greater than about 475° F. (246° C.), such as from about 450 to about 700° F. (232 to 371° C.), such as from 475 to about 600° F. (246 to 315° C.) is provided to the first dryer section 50. A lower temperature air is supplied to the second dryer section 53, such as air having a temperature less than about 500° F. (260° C.), more preferably less than about 470° F. (243° C.) and more preferably less than 450° F. (232° C.).

By providing the dryer sections 50, 53 with two different drying medium temperatures 82, 84 the drying and performance of each of the drying sections 50, 53 may be optimized and the overall drying efficiency may be improved. Improved drying efficiency allows the web to be fed at a greater speed to the dryer to increase the overall rate of production of tissue webs (i.e., production capacity). Moreover, it has also been discovered that the supply of high temperature air, such as air having a temperature greater than 500° F., to the first dryer section 50 generally does not cause the TAD fabric to be heated significantly above its thermal degradation temperature and may extend the useful life of the TAD fabric. Additionally, as the elevated temperature does not cause the cellulosic fibers making up the tissue web 38 to become singed or burned as the web 38 is passed over the first dryer cylinder 20, it remains sufficiently wet to maintain a sheet temperature less than about 450° F. and more preferably less than about 400° F., such as moisture ratio greater than about 0.05, such as from about 0.05 to about 0.35 g/g and more preferably from about 0.10 to about 0.30 g/g.

In general, the temperature supplied to the first dryer section 50 and the second dryer section 53 can be controlled using a variety of methods and/or techniques. For instance, two burners can be used in conjunction with two separate air supply channels. In this manner, the temperature of the air supplied to the first TAD can be controlled independently from the temperature of the air supplied to the second TAD such that the temperature within the first dryer section 50 is relatively constant and greater than the temperature within the second dryer section 53, which is also relatively constant.

Figure 2:
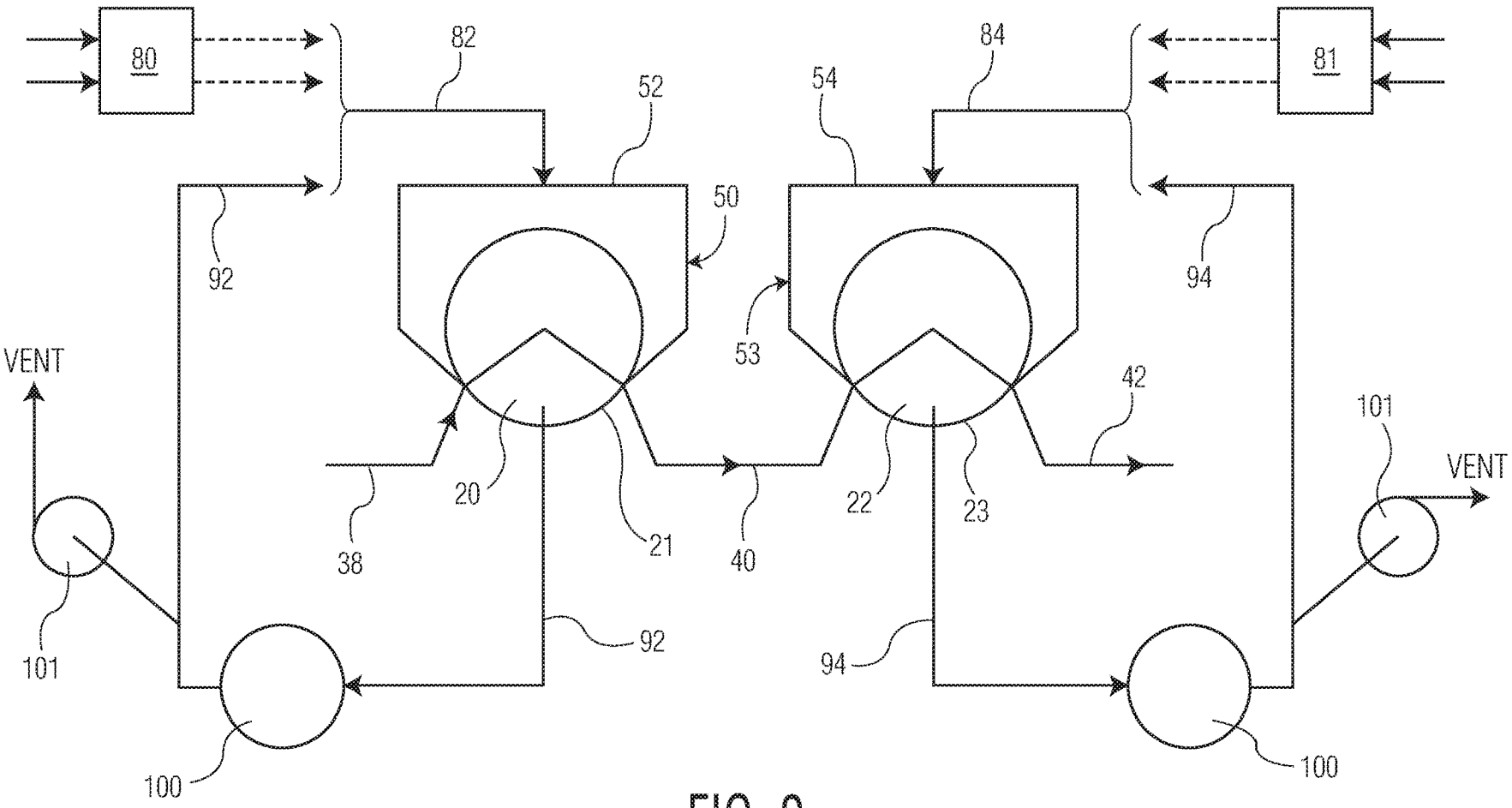
FIG. 2 is a schematic view of another through-air drying apparatus according to another embodiment of the present invention.

With reference now to FIG. 2, there is illustrated a schematic representation of a through-air dryer and process for carrying out the present invention. The first and second drying mediums 82, 84 comprise a mixture of the combustion products from a fuel burner 80, with a separate burner producing each of the drying mediums 82, 84. The resulting heated combustion products are combined with the recycled drying medium 92 to provide a first and second drying medium 82, 84 to be supplied to a first and a second TAD 50, 53.

The first drying medium 82, which may have a supply side temperature of from about 450 to about 600° F., is introduced to the first TAD 50 within the interior enclosure defined by hood 52. The velocity of the first drying medium 82 directs the drying medium to contact the outer supply side of moving web 38, passing the drying medium through web 38 as the medium 82 continues through the through-air drying fabric (not illustrated in FIG. 2), through the perforated outer shell 21 and into the interior cylinder 20 before exiting through outlets.

As the drying medium 82 passes through the web 38, the drying medium 82 raises the temperature of the web 38, thereby converting the water content of the web to steam. The steam is released from the web fibers/matrix and passes into the drying medium. The circulating fan 100 is used to circulate the drying medium as it exits the web 38. The used drying medium 92 is then recirculated in part to the feed stream of the drying medium along with additional live steam.

The returning or used dryer medium 92, upon exiting the web 38, will experience a temperature drop upon entry into the interior of the cylinder 20. Further, ambient air is typically entrained into the recirculating loop pathway of medium 92 by air leakage along gap regions of the hood baffle associated with the passage of web 38 into and out of TAD 50. To maintain a proper balance of the dryer medium constituents, a portion of the used dryer medium 92 may be vented using exhaust fans 101 to maintain a desired balance of the heated combustion products, including combustion air, high energy steam, and the recycled used dryer medium 92. The latter component may include ambient air entrained by movement of the web relative to the dryer.

A second drying medium 84 may be heated and supplied to a second TAD 53, in a fashion similar to that of the first drying medium 82. The second drying medium 84 also comprises a mixture of combustion products from a fuel burner 81. The resulting heated combustion products and recycled drying medium 94 provide a second drying medium 84 to be supplied to a second TAD 53. The second drying medium 84 may have a supply side temperature less than about 500° F. (260° C.), more preferably less than about 470° F. (243° C.) and more preferably less than 450° F. (232° C.). The second drying medium 84 is introduced to the second TAD 53 within the interior enclosure defined by hood 54.

As set forth above, it has been found that increasing the temperature of the first drying medium to greater than about 450° F. may be accomplished without negatively affecting the web, such as by singing or combusting the cellulosic fibers, by ensuring that the web is relatively wet, such as consistency greater than about 0.30 g/g as it passes over the first through-air dryer. As the moisture content of the web is increased, the temperature of the drying medium which may be used without scorching or burning the tissue web also increases. To maximize machine efficiency and to produce a tissue web having satisfactory properties however, it is generally preferred that the temperature of the partially dewatered web is maintained at a temperature less than about 450° F. and more preferably less than about 400° F., and that the supply side temperature of the first drying medium is greater than about 500° F. All the while the drying medium supplied to the first through-air drying has a free oxygen concentration of about 18 percent by volume or greater, such as from 18 to 24 percent by volume. In certain instances the drying medium may have a free oxygen concentration equal to or greater than the ambient oxygen concentration of the machine room air such as about 20 percent by volume or greater (20 percent, 21 percent, 22 percent, 23 percent, by volume, etc.), such as from about 20 to about 35 percent by volume.

Test Methods

GC/MS Analysis of Furan and Acetaldehyde

Fully dried tissue samples were collected and analyzed for furan and acetaldehyde by first sparging the samples and collecting the sparging gas using an Envirochem Purge-and-Trap (P/T) instrument having Tenax-TA (2,6-diphenyl-p-phenylene oxide porous polymer) as a sorbent. Next, the compounds are thermally desorbed from the trap by rapid heating and injected into a Gas Chromatography (GC) column to separate the compounds based on their polarities and volatility. Once the compounds were separated by gas chromatography, the compounds were analyzed by Mass Spectrometer (MS). All analysis was performed using a Hewlett-Packard 5988A GC/MS employing the following conditions:

| | |
|---|---|
| Instrument | HP 5988A GC/MS |
| Chromatograph | HP 5980 |
| Column | DB-624 (30 m, 0.25 mm ID, 1.4μ film) |
| Temperature | −10° C. (hold 1 min.) to 40° C. @ 5° C./min. then 150° C. @ 10° C./min. |

-continued

| | |
|---|---|
| | then to 260° C. @ 15° C./min. (hold 5 min.) |
| Carrier Gas | Helium (direct connection) |
| Detector-GC/MS | |
| Source Temp. | 200° C. |
| Interface | 225° C. |
| EM | 1559 v. |
| HED | 4000 v. |
| Scan Range | 35-350 dalton |
| Delay | 0 min. |
| Evirochem Unacon 810 Thermal Desorber | |
| Initial Carrier Flow | 30 min. (sparge) |
| Secondary Carrier Flow | 7 min. (dry sparge) |
| Trap to Trap Time | 2 min. |
| Trap to Column Time | 10 min. |
| Trap 1 | 261° C. |
| Trap 2 | 276° C. |
| Valve Compartment | 220° C. |
| Trap Block | 203° C. |
| Transfer Line A | 46% (250° C.) |
| Transfer Line B | 36% (257° C.) |
| Ext. Tube Desorber | 200° C. |
| Sorbent Trap | Glass Beads/Silica Gel/ Tenax/Ambersorb/Charcoal |

The apparatus and methods of manufacturing tissue webs, and in a particularly preferred embodiment through-air dried tissue webs, have been described in detail with respect to the foregoing. It will be appreciated that those skilled in the art, upon attaining an understanding of the foregoing, may readily conceive of alterations to, variations of, and equivalents thereto. Accordingly, the scope of the present invention should be assessed as that of the appended claims and any equivalents thereto and the following embodiments:

In a first embodiment the present invention provides a method of through-air drying a tissue web comprising the steps of: transferring a wet tissue web having a moisture ratio of about 2.3 g/g or less to a first through-air drying fabric; transporting the wet tissue web over a first through-air dryer supplied with a drying medium having a temperature greater than about 475° F.; partially drying the wet web to a moisture ratio from about 0.20 to about 0.70 g/g to yield a partially dried tissue web; transporting the partially dried tissue web over a second through-air dryer supplied with a drying medium having a temperature transporting the partially dried tissue web over a second through-air dryer supplied with a drying medium having a temperature less than the temperature of the drying medium supplied to the first through-air dryer; and drying the partially dried web to a moisture ratio less than about 0.10 g/g. In certain instances the partially dried web may be finally dried as it passes over the second through-air drier such that the web has a moisture ratio less than about 0.05 g/g, such as from about 0.01 to about 0.05 g/g as it exits the second through-air drier.

In a second embodiment the present invention provides the method of the first embodiment wherein the drying medium supplied to the first through-air dryer is from 475 to about 600° F. (246 to 315° C.) and wherein the drying medium supplied to the second through-air dryer is from about 375 to 475° F. (190 to 246° C.).

In a third embodiment the present invention provides the method of the first or second embodiments wherein the drying medium supplied to the first through-air dryer is from about 475 to about 600° F. and has an oxygen concentration of about 18 percent by volume or greater.

In a fourth embodiment the present invention provides the method of any one of the first through the third embodiments wherein the through-air drying fabric is woven from polyester polyethyleneterephthalate (PET), polyphenylenesulfide (PPS) or polyetheretherketone (PEEK) monofilament yarns.

In a fifth embodiment the present invention provides the method of any one of the first through the fourth embodiments wherein the through-air drying fabric has a pair of lateral edges and the distance there between defines a fabric width (W1) and the wet web has a pair of spaced apart lateral edges and the distance there between defines a web width (W2) and wherein W1 and W2 are substantially equal.

In a sixth embodiment the present invention provides the method of any one of the first through the fifth embodiments wherein the partially dewatered web is dried to a consistency of at least about 95 percent by the second through-air dryer to yield a dried tissue web and further comprising the steps of winding the dried tissue web into a roll.

In a seventh embodiment the present invention provides the method of any one of the first through the sixth embodiments wherein the partially dewatered web is dried to a consistency of at least about 60 percent by the second through-air dryer to yield a partially dried tissue web and further comprising the step of adhering the partially dried web to a Yankee dryer and drying the web to a consistency of at least about 95 percent.

In an eighth embodiment the present invention provides the method of any one of the first through the seventh embodiments wherein the dried tissue web has a furan concentration less than about 5.0 ppm and an acetaldehyde concentration less than about 5.0 ppm.

In a ninth embodiment the present invention provides the method of any one of the first through the eighth embodiments wherein the dried tissue web is substantially free from furan and acetaldehyde.

In a tenth embodiment the invention provides the method of any one of the first through the ninth embodiments wherein the temperature of the partially dried tissue web is less than about 400° F.

In an eleventh embodiment the present invention provides the method of any one of the of the first through the tenth embodiments wherein the first drying medium has an oxygen concentration from about 18 to about 20 percent, by volume, and is produced by combusting air using a first burner and the second drying medium has an oxygen concentration from about 18 to about 20 percent, by volume, and is produced by combusting air using a second burner.

In a twelfth embodiment the present invention provides a method of through-air drying a tissue web comprising the steps of: transferring a wet tissue web having a moisture ratio of about 2.3 g/g or less to a first through-air drying fabric; transporting the wet tissue web over a first through-air dryer supplied with a drying medium having a temperature of 450 to 600° F. (232 to 316° C.) and the moisture ratio of the partially dried web is greater than:

$$\frac{\ln\left(\frac{(T_{supply} - 375^\circ\text{ F.})}{(T_{supply} - T_{wet\ bulb})} - 1\right)}{2.3}$$

transporting the partially dried tissue web over a second through-air dryer supplied with a drying medium having a temperature less than the temperature of the drying medium supplied to the first through-air dryer; and drying the partially dried web to a moisture ratio less than about 0.10 g/g.

In a thirteenth embodiment the present invention provides the method of the twelfth embodiment wherein the drying medium supplied to the first through-air dryer has an oxygen concentration of about 18 percent by volume or greater.

In a fourteenth embodiment the present invention provides the method of twelfth or thirteenth embodiments wherein the through-air drying fabric is woven from polyester polyethyleneterephthalate (PET), polyphenylenesulfide (PPS) or polyetheretherketone (PEEK) monofilament yarns.

In a fifteenth embodiment the present invention provides the method of any one of the twelfth through the fourteenth embodiments further comprising the step of adhering the dried tissue web to a Yankee dryer and drying the web to a consistency of at least about 95 percent.

In a sixteenth embodiment the present invention provides the method of any one of the twelfth through the fifteenth embodiments wherein the dried tissue web has a furan concentration less than about 5.0 ppm and an acetaldehyde concentration less than about 5.0 ppm.

What is claimed is:

1. A method of through-air drying a tissue web comprising the steps of:

a. transferring a wet tissue web to a first through-air drying fabric;

b. transporting the wet tissue web over a first through-air dryer supplied with a drying medium having a temperature greater than 450° F. (232° C.);

c. partially drying the wet web to a moisture ratio less than about 0.30 g/g to yield a partially dried tissue web;

d. transporting the partially dried tissue web over a second through-air dryer supplied with a drying medium having a temperature less than the temperature of the drying medium supplied to the first through-air dryer; and e. drying the partially dried web to a moisture ratio less than about 0.1 g/g to yield a dried tissue web.

2. The method of claim 1 wherein the drying medium supplied to the first through-air dryer is from about 475 to about 600° F. (246 to 315° C.) and wherein the drying medium supplied to the second through-air dryer is from about 375 to about 425° F. (190 to 218° C.).

3. The method of claim 1 wherein the partially dried web has a moisture ratio from about 0.10 to about 0.25 g/g.

4. The method of claim 1 wherein the web comprises cellulosic fibers and the wet tissue web has a moisture ratio from about 1.0 to about 2.5 g/g.

5. The method of claim 1 wherein the drying medium supplied to the first through-air dryer is from about 475 to about 600° F. (246 to 315° C.) and has an oxygen concentration of about 18 percent by volume or greater.

6. The method of claim 1 wherein the through-air drying fabric is woven from polyester polyethyleneterephthalate (PET), polyphenylenesulfide (PPS) or polyetheretherketone (PEEK) monofilament yarns.

7. The method of claim 1 wherein the through-air drying fabric has a pair of lateral edges and the distance there between defines a fabric width (W1) and the wet web has a pair of spaced apart lateral edges and the distance there between defines a web width (W2) and wherein W1 and W2 are substantially equal.

8. The method of claim 7 further comprising the step of trimming the lateral edges of the web to yield a trimmed web, wherein the width of the trimmed web (W3) is less than W2.

9. The method of claim 1 further comprising the step of adhering the dried tissue web to a Yankee dryer and drying the web to a consistency of at least about 95 percent.

10. The method of claim 1 wherein the temperature of the wet web does not exceed 375° F. (190° C.) as it is transported over the first through-air drier.

11. The method of claim 1 wherein the dried tissue web has a furan concentration less than about 5.0 ppm and an acetaldehyde concentration less than about 5.0 ppm.

12. The method of claim 1 wherein the dried tissue web is substantially free from furan and acetaldehyde.

13. A method of manufacturing an uncreped through-air dried tissue web comprising the steps of:

a. transferring a wet tissue web comprising cellulosic fibers and having a moisture ratio from 0.5 to 2.5 g/g to a first through-air drying fabric;

b. transporting the wet tissue web over a first through-air dryer supplied with a drying medium having a temperature from about 475 to about 600° F. (246 to 315° C.);

c. partially drying the wet web to a moisture ratio from about 0.20 to about 0.30 g/g to yield a partially dried tissue web;

d. transporting the partially dried tissue web over a second through-air dryer supplied with a drying medium having a temperature from about 375 to about 425° F. (190 to 218° C.);

e. drying the partially dried web to a moisture ratio less than about 0.05 g/g; and f. spirally winding the dried tissue web onto a core.

14. The method of claim 13 wherein the drying medium supplied to the first through-air dryer has an oxygen concentration from about 18 to about 21 percent by volume.

15. The method of claim 13 wherein the dried tissue web has a basis weight of about 10 grams per square meter or greater and a sheet bulk of about 4 cubic centimeters per gram or greater.

16. The method of claim 13 wherein the through-air drying fabric is woven from polyester polyethyleneterephthalate (PET), polyphenylenesulfide (PPS) or polyetheretherketone (PEEK) monofilament yarns.

17. The method of claim 13 wherein the through-air drying fabric has a pair of lateral edges and the distance there between defines a fabric width (W1) and the wet web has a pair of spaced apart lateral edges and the distance there between defines a web width (W2) and wherein W1 and W2 are substantially equal.

18. The method of claim 13 wherein the temperature of the wet web does not exceed 375° F. (190° C.) as it is transported over the first through-air drier.

19. The method of claim 13 wherein the dried tissue web has a furan concentration less than about 5.0 ppm and an acetaldehyde concentration less than about 5.0 ppm.

20. The method of claim 13 wherein the dried tissue web is substantially free from furan and acetaldehyde.

* * * * *